US005713144A

United States Patent [19]

Haraoka

[11] Patent Number: 5,713,144

[45] Date of Patent: Feb. 3, 1998

[54] LINEAR EXCAVATION CONTROL APPARATUS FOR A HYDRAULIC POWER SHOVEL

[75] Inventor: Yoshinao Haraoka, Osaka-fu, Japan

[73] Assignee: Komatsu Ltd., Tokyo, Japan

[21] Appl. No.: 648,107

[22] PCT Filed: Nov. 30, 1994

[86] PCT No.: PCT/JP94/02017

§ 371 Date: May 17, 1996

§ 102(e) Date: May 17, 1996

[87] PCT Pub. No.: WO95/15420

PCT Pub. Date: Jun. 8, 1995

[30] Foreign Application Priority Data

| | | | |
|---|---|---|---|
| Nov. 30, 1993 | [JP] | Japan | 5-299553 |
| Feb. 2, 1994 | [JP] | Japan | 6-10785 |
| Feb. 2, 1994 | [JP] | Japan | 6-10828 |

[51] Int. Cl.[6] ..... E02F 5/02; G05D 1/02

[52] U.S. Cl. ..... 37/348; 172/4.5; 414/699; 364/424.07

[58] Field of Search ..... 37/348, 382; 172/4.5, 172/2; 414/698, 699, 694; 364/424.07

[56] References Cited

U.S. PATENT DOCUMENTS

| | | | |
|---|---|---|---|
| 3,997,071 | 12/1976 | Teach | 414/698 X |
| 4,028,822 | 6/1977 | Teach | 37/906 X |
| 4,034,490 | 7/1977 | Teach | 37/348 |
| 4,050,171 | 9/1977 | Teach | 37/348 |
| 4,129,224 | 12/1978 | Teach | 414/698 X |
| 4,244,123 | 1/1981 | Lazure et al. | 37/348 |
| 4,277,899 | 7/1981 | Guthoff | 37/443 |
| 4,393,606 | 7/1983 | Warnecke | 37/443 |
| 4,726,682 | 2/1988 | Harms et al. | 37/906 X |
| 4,888,890 | 12/1989 | Studebaker et al. | 37/348 |
| 5,528,498 | 6/1996 | Scholl | 37/419 X |

FOREIGN PATENT DOCUMENTS

| | | |
|---|---|---|
| 52-82804 | 7/1977 | Japan . |
| 56-105030 | 8/1981 | Japan . |
| 61-191729 | 8/1986 | Japan . |
| 61-270421 | 11/1986 | Japan . |
| 3-187420 | 8/1991 | Japan . |
| 3-295933 | 12/1991 | Japan . |
| 4-161525 | 6/1992 | Japan . |

*Primary Examiner*—Terry Lee Melius
*Assistant Examiner*—Thomas A. Beach
*Attorney, Agent, or Firm*—Wenderoth Lind & Ponack

[57] ABSTRACT

A linear excavation control apparatus for a hydraulic power shovel has a laser oscillator installed on the surface of a target area of excavation, a laser beam receiving unit mounted upon a vehicle body of the hydraulic power shovel and a controller for controlling an attitude of excavation by a bucket. The inclination of the laser beam receiving unit and the attitude of excavation of the bucket can be adjusted.

18 Claims, 16 Drawing Sheets

LINEAR EXCAVATION CONTROL APPARATUS FOR A HYDRAULIC POWER SHOVEL

TECHNICAL FIELD

The present invention relates to a linear excavation control apparatus for a hydraulic power shovel. Particularly, the invention relates to an apparatus for carrying out a linearized excavating operation by linearly displacing the end portion of a bucket of a hydraulic power shovel. The linear displacement of an excavation member, e.g., a bucket is controlled by using a laser beam as a reference.

BACKGROUND ART

A known linear excavation control apparatus for a hydraulic power shovel is disclosed in Unexamined Japanese Patent Publication No. Hei 03-295,933. Such an apparatus is provided with a laser oscillator installed on the surface of a target area or site of excavation. The apparatus also has a laser beam receiving unit mounted on a vehicle body of the hydraulic power shovel. The depth of the excavation carried out by the bucket is controlled by a controller which detects the height of the vehicle body in response to a signal. The signal is representative of a laser beam receiving position at a laser beam receiving unit. Thus, the height of the vehicle body is detected by means of a laser beam. On the basis of this detected height, and a preset depth of the excavation, the height of the end portion of the bucket is controlled so that the edge of the bucket is able to linearly excavate while being displaced at a gradient defined by the laser beam. The bucket excavates while being moved in parallel to the laser beam. The apparatus has been used, primarily, for excavating a normal surface or a groove in which a pipe is buried.

However, since the prior art laser beam receiving unit is mounted in a vertical orientation with respect to the vehicle body, when the angle between the laser beam b and a horizontal line is large, the vehicle body c can only travel a short distance L and still remain in a zone in which the laser beam receiving unit d is capable of accepting the laser beam b. Therefore, when the angle of the laser with respect to the horizontal line is increased, the distance that can be linearly excavated is shortened.

Problems with the depth of excavation also result when it is necessary to turn the vehicle body with respect to the vehicle base. See FIG. 12 for an illustration of such a turn. More specifically, when the laser beam is inclined with respect to a horizontal line, a turning of the vehicle body will result in a turning of the excavating bucket as well and there will also be a change in the height of the excavating end portion of the bucket with respect to the laser beam. Since the height of the vehicle body is the same, the height of the excavating end portion of the bucket would not normally be changed. There is no indication that the height of the bucket has been affected. It follows, therefore, that an error will develop in the depth of excavation, corresponding to a difference in the height of the excavating end portion of the bucket with respect to the laser beam due to the turned vehicle body.

Another problem exists when the surface upon which the vehicle rests is tilted to the left or to the right with respect to the desired excavated surface. See FIG. 16 for an illustration of such tilting. If the attitude of a vehicle is rotated in such a manner, the bucket will also be tilted. This causes the bucket to deviate from the orientation of the desired surface of excavation.

It is an object of the present invention to provide a linear excavation control apparatus for a power shovel which is capable of increasing the distance that can be linearly excavated for situations where the angle of the laser beam with respect to a horizontal line is increased. Another object of the present invention is to allow the depth of excavation with respect to the laser beam to be kept constant even if the vehicle body is turned. It is also an object of the present invention to provide a linear excavation control apparatus which can maintain the attitude of an excavating bucket even when the surface of the excavation site is tilted to the left or right with respect to the direction of excavation.

SUMMARY OF THE INVENTION

A linear excavation control apparatus according to the present invention has a laser oscillator installed on a surface of a target site of excavation, and a laser beam receiving unit mounted upon a vehicle body of the said hydraulic power shovel. The apparatus also has a controller for controlling an attitude of excavation of an excavating member, e.g., a bucket, in response to a position at which a laser beam transmitted from the laser oscillator impinges the laser light beam receiving unit. The inclination of the laser beam receiving unit and the attitude of excavation of the bucket can be adjusted.

According to a first embodiment, there is provided a linear excavation control apparatus for a hydraulic power shovel in which the laser beam receiving unit can be angled with respect to a vertical line. Accordingly, even if the angle of the laser beam with respect to a horizontal line is increased, the laser beam receiving unit 10 will be less liable to enter into a zone in which it is unable to receive the laser beam. Therefore, the distance that can be linearly excavated is increased.

The linear excavation control apparatus of the present invention has a detection means for detecting an angle of inclination of the laser beam receiving unit. The angle of inclination is used to correct the information received by the laser beam receiving unit so as to compensate for the angle.

It is also preferable that the above mentioned detection means have an inclinometer or a potentiometer.

According to a second embodiment, the linear excavation control apparatus for a hydraulic power shovel, which has a vehicle body turnable about a traveling body, is capable of correcting for changes in the height of the bucket caused by a turning of the vehicle body. The apparatus has a turning angle sensor for detecting a turning angle of the vehicle body, and a controller for computing a height of an end portion of the bucket with respect to a reference position of the vehicle body. The height is calculated in response to respective detection signals from a boom angle sensor, an arm sensor and a bucket sensor. The displacement of the height is detected and calculated with respect to the variation in the laser beam receiving position at the laser beam receiving unit. In response to the detection signal from the turning angle sensor and the signal representative of the angle of the laser beam, the amount of displacement in height of the bucket with respect to the laser beam can be computed for situations where the vehicle body is turned. In order to keep the height of the bucket constant with respect to the laser beam, operating commands are provided to respective actuators for the boom, the arm and the bucket in response to a signal representative of the amount of displacement in the height of the vehicle body and a signal representative of the amount of displacement in the height of the end portion of the bucket.

Since a correction is made for the height of the end portion of the bucket based on the turning angle and the angle between the laser beam and the horizontal line, the depth of excavation can be kept constant with respect to the laser beam even if the excavation is carried out with the laser inclined and the vehicle body turned. To ensure that the turning angle is computed with respect to the direction of the laser beam, the turning angle of the vehicle body should be computed from the signal of the turning angle sensor before the vehicle is turned and computed again from the signal of the turning sensor after the vehicle has been turned.

According to a third embodiment, the linear excavation control apparatus is for use with a hydraulic power shovel, in which the vehicle body is mounted on a traveling body such that it can be tilted to the left or to the right with respect to the direction of travel of the travelling body, i.e., the attitude of the vehicle body can be changed. In order to accomplish this change in attitude, there are provided inclination means for tilting the vehicle body to the left and to the right. An inclinometer detects the angle of rotation of the vehicle body.

The controller operates the inclination means in response to a detection signal from the inclinometer, so as to orient the vehicle body in a horizontal direction. Therefore, if the traveling body is tilted to the left or to the right due to a side slope of the ground, the vehicle body will be automatically adjusted so as to assume a horizontal attitude. Thus an excavating operation can be carried out while maintaining the correct attitude of the surface of excavation by the bucket.

The inclination means can be realized by an inclination cylinder and a switching valve. The inclination cylinder is coupled between the vehicle body and the traveling body. The switching valve supplies the inclination cylinder with a pressure fluid to tilt the vehicle body. The controller receives an inclination signal from the inclinometer indicating the orientation of the vehicle body. Using this signal, the controller switches the switching valve so as to control the inclination cylinder to tilt the vehicle body to the desired attitude.

BEST MODES FOR CARRYING OUT THE INVENTION

Hereinafter, suitable embodiments of a linear excavation control apparatus for a hydraulic shovel according to the present invention will be set out with reference to the accompanying drawings.

An explanation will now be given with respect to the first embodiment of the present invention.

Figure 1:
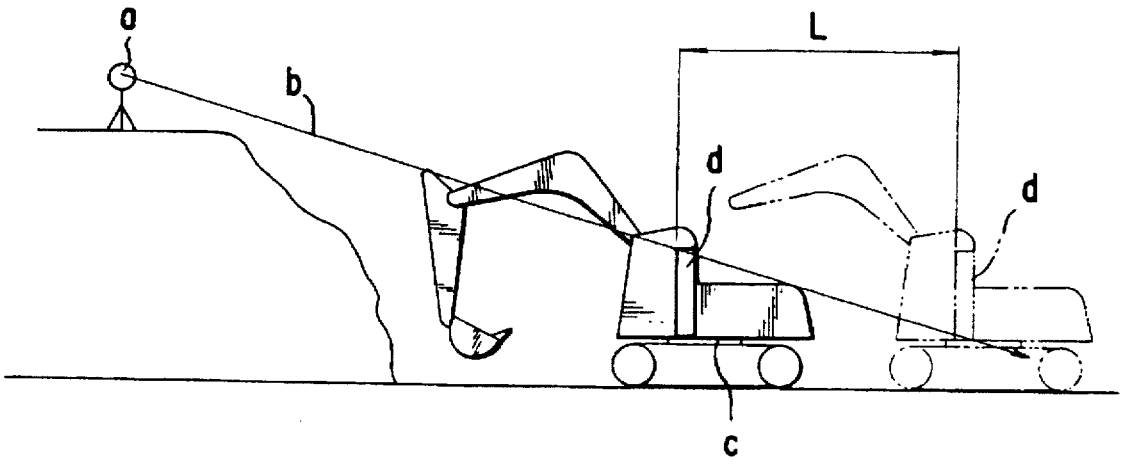
FIG. 1 is a diagrammatic view illustrating an inconvenience that has been encountered in the prior art.
Figure 2:
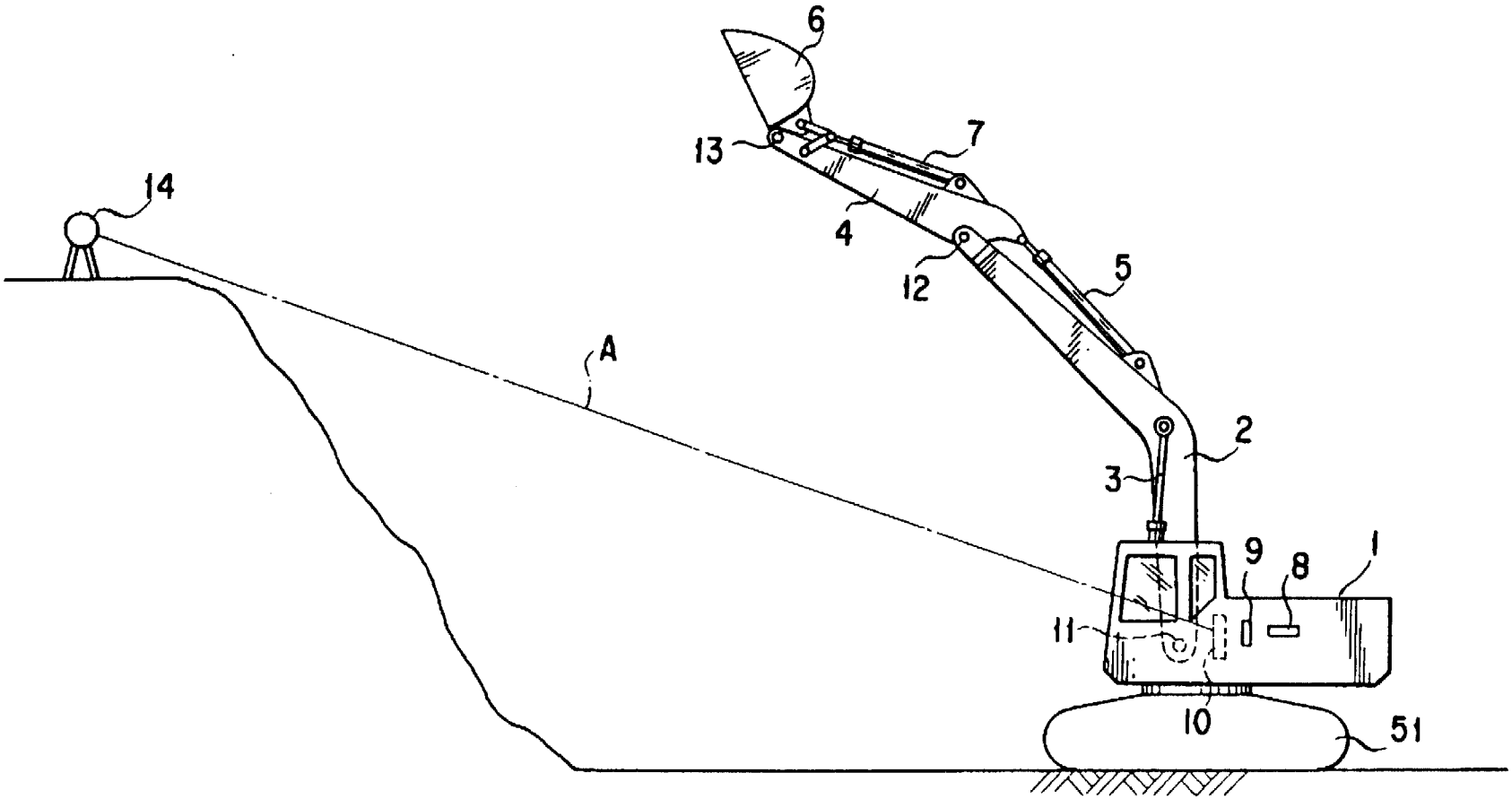
FIG. 2 is a front view illustrating the entire system of a first embodiment of a linear excavation control apparatus for a hydraulic power shovel according to the present invention.

As shown in FIG. 2, a hydraulic power shovel is constructed by mounting a boom 2 on a vehicle body 1 which is in turn mounted on a traveling body 51 so that the boom 2 can be turned upwards and downwards with a boom cylinder 3. An arm 4 is mounted on the boom 2 so that the arm 4 can be turned upwards and downwards with an arm cylinder 5. An excavating member such as a bucket 6 is mounted on the arm 4 so that the bucket 6 can be turned upwards and downwards with a bucket cylinder 7. The vehicle body 1 is provided with a forward and backward inclinometer 8, a leftward and rightward inclinometer 9 and a laser beam receiving unit 10 for receiving a laser light beam. The leftward and rightward inclinometer detects an angle of inclination of the vehicle body in a direction orthogonal to the direction of travel of the traveling body. There are also provided a boom angle sensor 11 at a turning fulcrum for the boom 2, an arm angle sensor 12 at a turning fulcrum for the arm 4 and a bucket angle sensor 13 at a turning fulcrum for the bucket 6. A laser oscillator 14 for emitting a laser beam A is installed on a target area or site of excavation. The laser beam is received by the laser beam receiving unit 10.

Figure 3:
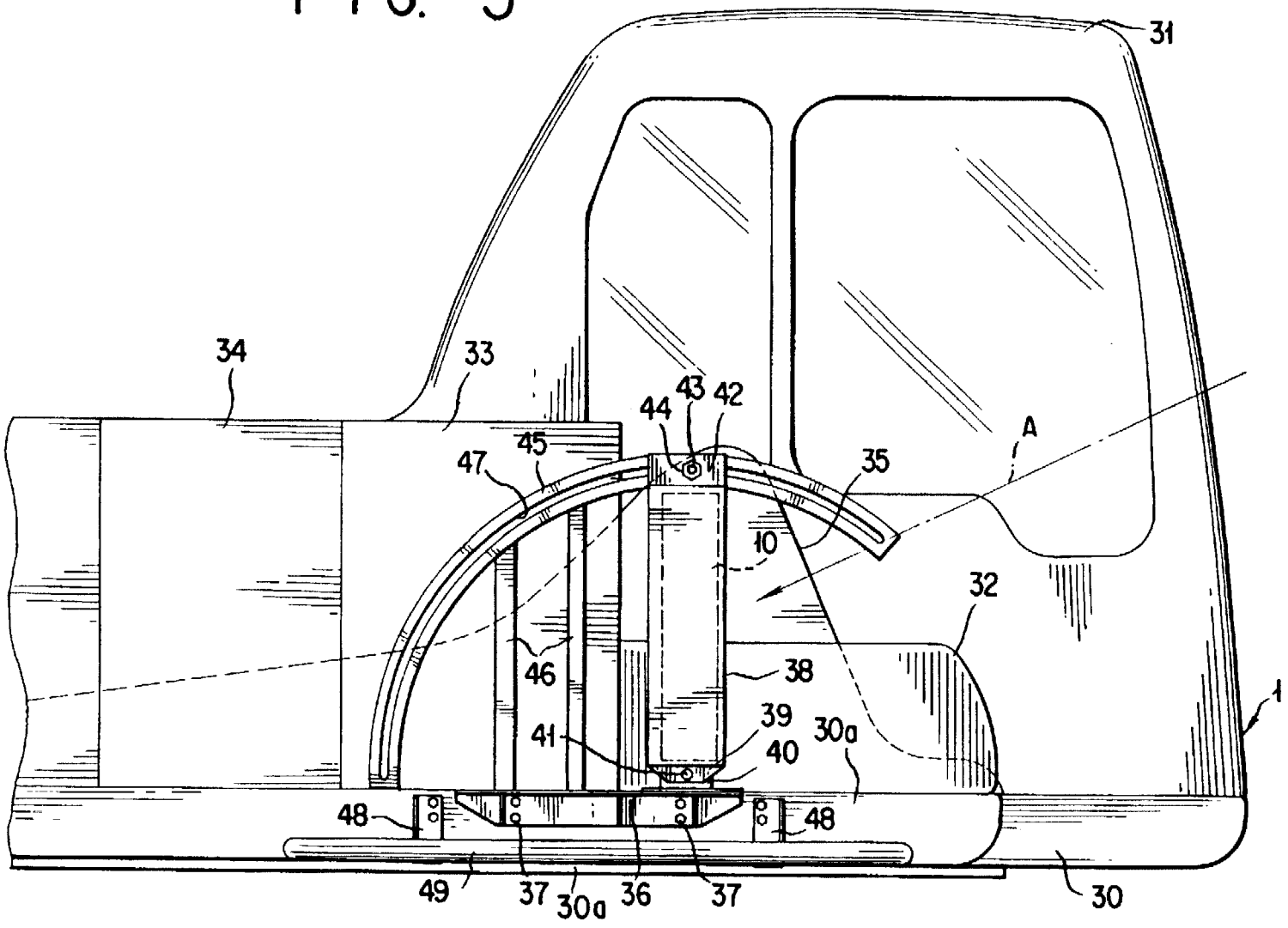
FIG. 3 is a front view illustrating a certain attachment structure for a laser beam receiving unit in the above mentioned first embodiment of the present invention.
Figure 4:
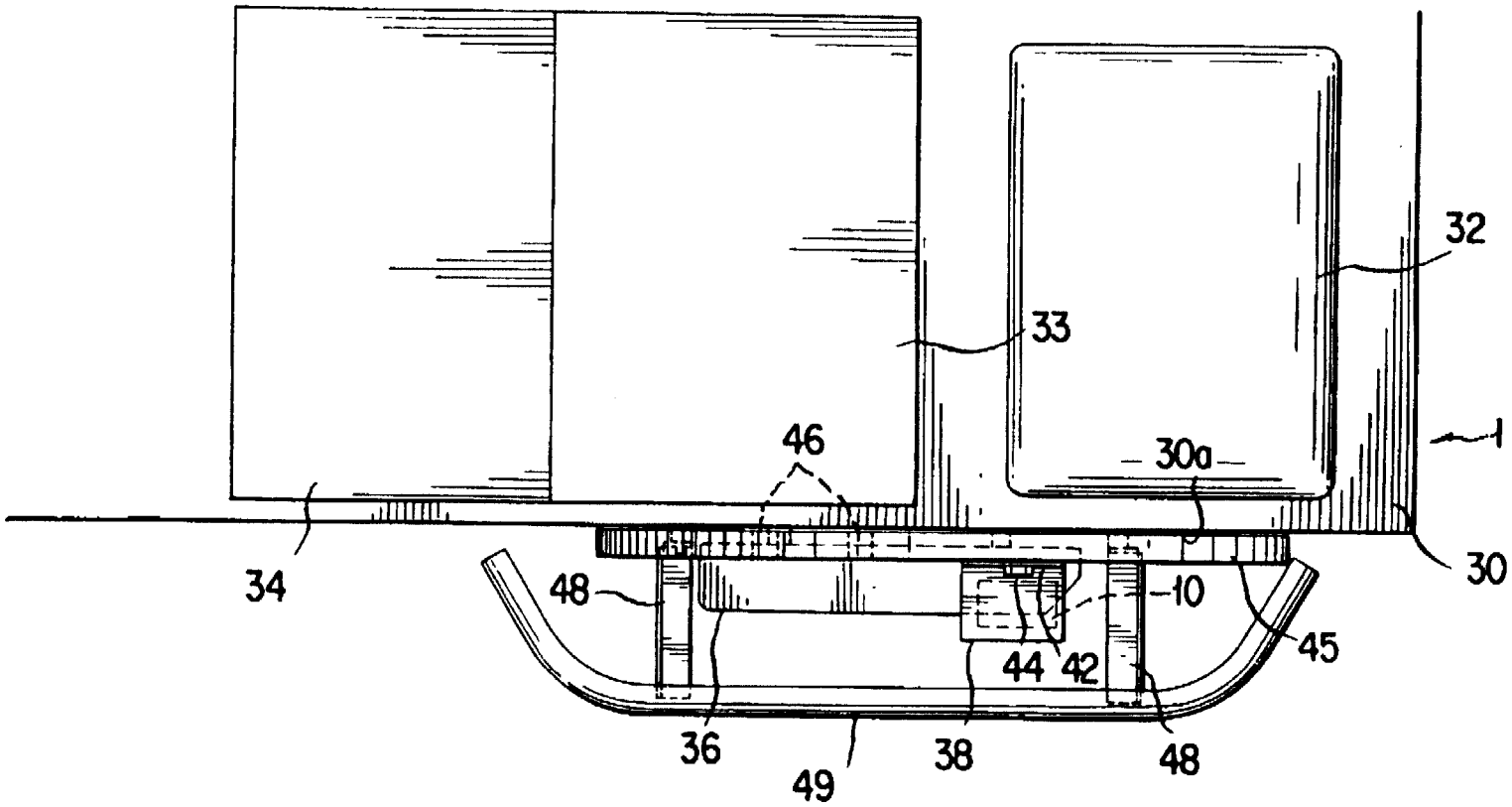
FIG. 4 is a top plan view illustrating a construction that is shown in FIG. 3.
Figure 5:
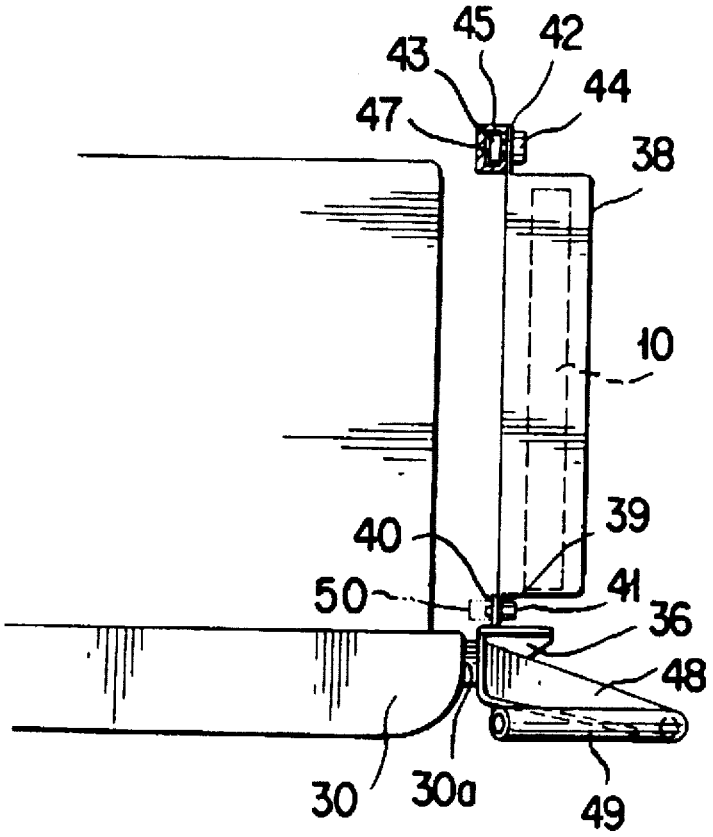
FIG. 5 is a side elevational view illustrating a construction that is shown in FIG. 3.

An explanation will now be made with respect to a structure for mounting the laser light beam receiving unit 10 on the vehicle body 1 with reference to FIGS. 3, 4 and 5.

The vehicle body 1 has mounted thereon a driving cab 31 on either the left hand side or the right hand side thereof at a forward portion of the frame body 30. A battery casing 32 is mounted on the other of the left and right hand sides at a forward portion of the frame body 30. A fuel tank 33 and an operating oil tank 34 is mounted at rearward portions of the battery casing 32. The vehicle body 1 also has mounted thereon a boom mounting frame 35 midway between the left hand side and the right hand side at a forward portion of the frame body 30 and an engine and so forth at a rearward portion of the frame body 30. A laser beam receiving unit mounting body 36 which is attached to a surface 30a is also mounted at a forward portion of the frame body 30 by means of bolts 37.

The laser beam receiving unit 10 is attached to a housing 38 at a lower attachment portion 39 thereof. The housing 38 is coupled to a bracket 40 so as to be capable of being swung forwards and backwards about a transverse axis 41. An upper attachment portion 42 of the housing 38 is securely coupled at a predetermined position to a guide body 45 by means of a bolt 48 and a nut 44. The guide body 45 is fastened to the laser beam receiving unit mounting body 36 by means of stays 46 and is formed with an arcuate guide groove 47 centered on the above mentioned transverse axis 41. An axial portion of the bolt 43 is thereby slidable along the guide groove 47. The housing 38 may be swung to a predetermined position when the nut 44 is loosened and the upper attachment portion 42 may be fastened and fixed to the guide body 45 by fastening the nut 44. Since the housing 38 can be swung forwards and rearwards about the transverse axis 41 by loosening the nut 44 and can also be secured at a swing position as desired by fastening the nut 44, the laser beam receiving unit 10 is capable of being inclined forwards and backwards with respect to a vertical line.

The side surface 30*a* disposed at a forward portion of the frame body 30 is provided via a pair of brackets 48 and 48 with a protective member 49 for preventing the laser beam receiving unit 10 from colliding with obstacles.

Figure 6:
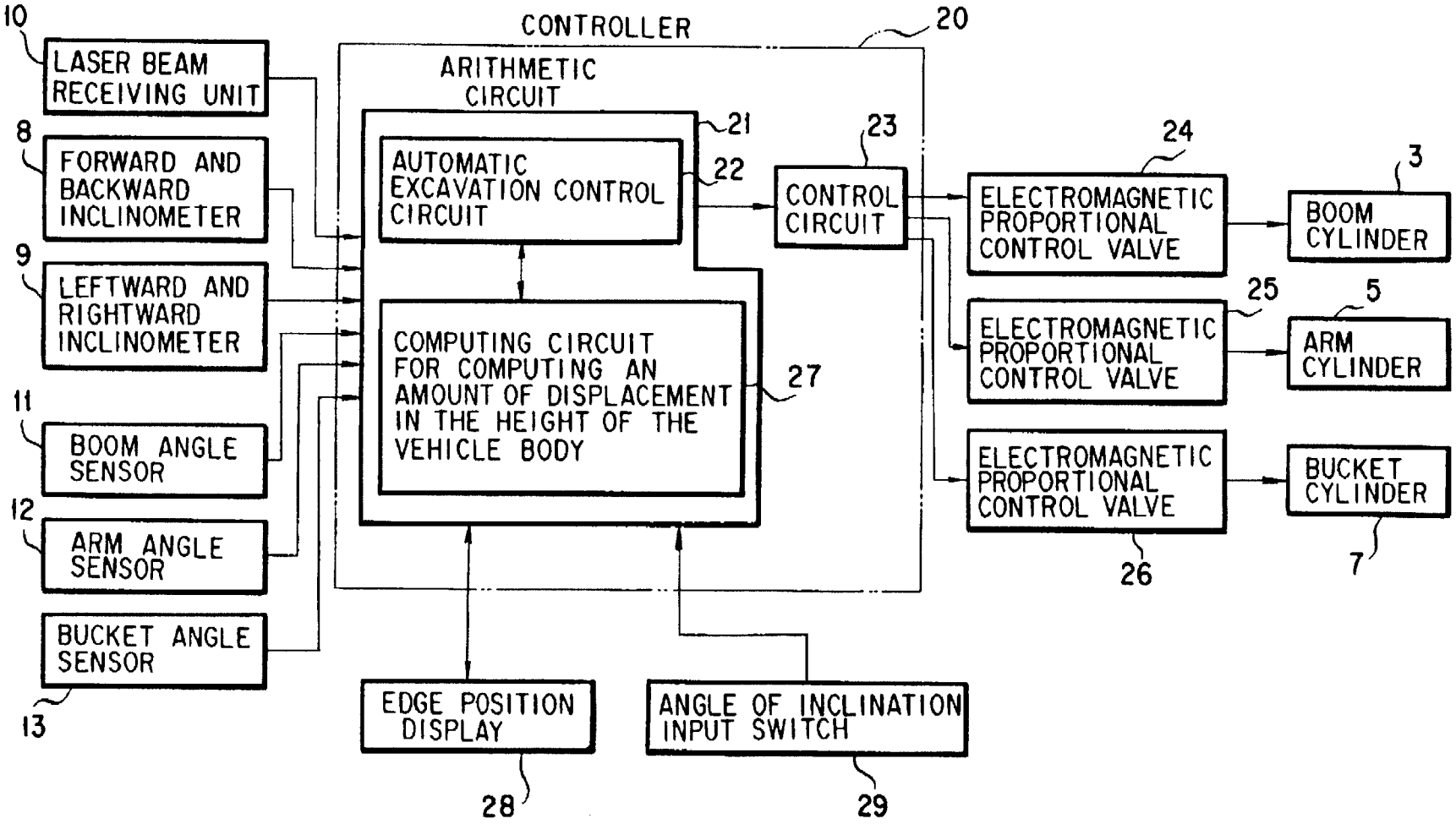
FIG. 6 is a circuit diagram illustrating a control circuit that is used in the above mentioned first embodiment of the present invention.

An explanation will now be given with respect to a certain example of the control circuit in the present embodiment with reference to FIG. 6.

The respective signals of the forward and backward inclinometer 8, the leftward and rightward inclinometer 9, the boom angle sensor 11, the arm angle sensor 12 and the bucket angle sensor 13 are input into an automatic excavation control circuit 22 where they are processed as in the prior art. The automatic excavation control circuit 22 will then furnish the control circuit 23 with control commands which are based upon the processing results. Control currents will then be sent from the control circuit 23 to respective electromagnetic valves 24, 25 and 26 for controlling the operations of the boom 2, the arm 4 and the bucket 6. Thus, the boom cylinder 3, the arm cylinder 5 and the bucket cylinder 7 will be operated to control the height of the end portion of the bucket 6 and to linearly displace the bucket 6 so as to perform a groove excavating operation.

The laser beam receiving unit 10 will detect a displacement of the vehicle body 1 by detecting a displacement of the laser beam receiving unit 10 relative to the laser light beam A. A detection signal representing such a displacement is input into a computing circuit 27. The computing circuit 27 receives the detection signal and a signal from each of the inclinometers 8 and 9. The signal for the inclinometer 8 represents the degree of forward or backward inclination of the vehicle body 1. The signal from the inclinometer 9 represents the degree of leftward or rightward inclination of the vehicle body 1 orthogonal to a direction of travel of the traveling body. From the detection signal and from the inclinometer signals, the computing circuit 27 computes an amount of variation in the height of the vehicle body 1 and provides a corrective signal that is representative thereof. This signal is fed back to the automatic excavation control circuit 22 in order to modify the control commands. The automatic excavation control circuit 22 also indicates the edge position of the excavating bucket on an edge position display 28 located on the basis of the corrected control commands.

An explanation will now be made with respect to a corrective operation that is to be employed when the laser beam receiving unit 10 is inclined with respect to a vertical line.

Figure 7:
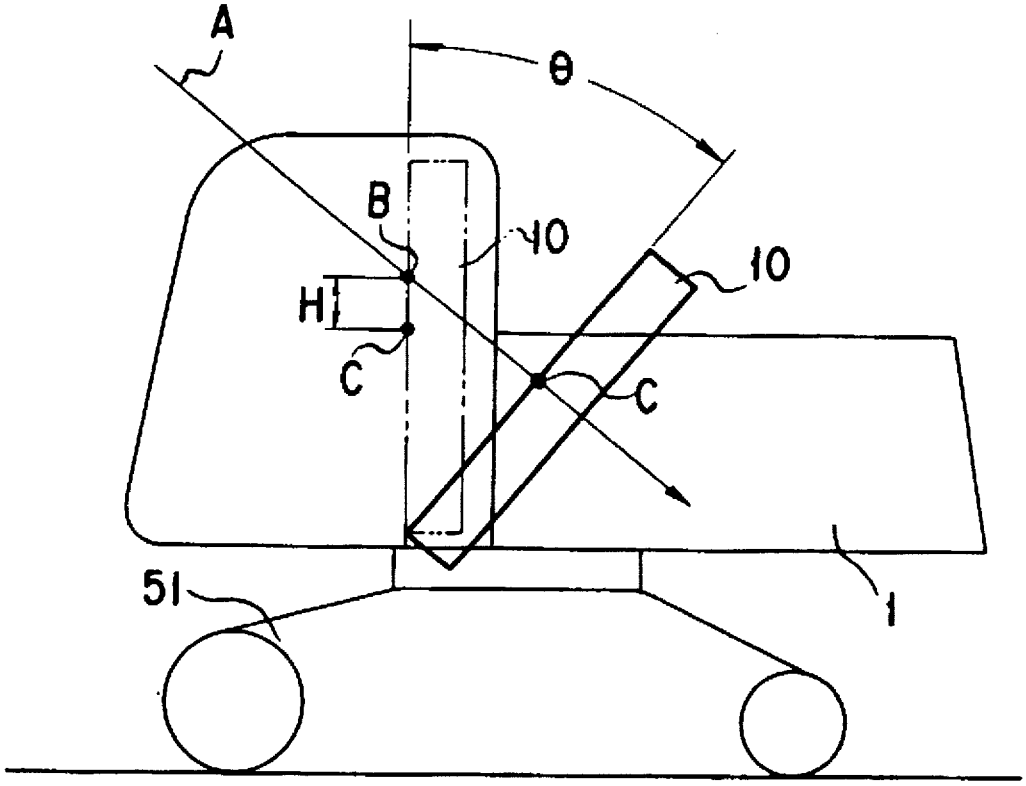
FIG. 7 is a diagrammatic view illustrating how a laser beam receiving position is varied in the event that the laser beam receiving unit is inclined.

As shown in FIG. 7, a beam receiving position B as taken when the laser beam receiving unit 10 is oriented vertically and a beam receiving position C as taken when the laser beam receiving unit 10 is inclined will be deviated from each other by a distance H that depends on an angle of inclination θ of the laser light beam receiving unit 10. The angle of inclination θ is measured by an inclinometer and is entered into the vehicle body height displacement amount computing circuit 27 in the controller 20 by means of an angle of inclination input switch 29. The angle of inclination is entered so that the laser beam receiving height at the laser beam receiving unit 10 may be corrected so as to represent the height of the laser light beam when the laser beam receiving unit 10 is oriented vertically. In this way, the height of the vehicle body 1 may be obtained.

For example, a formula of correction can be expressed as (the actual laser beam receiving height)÷cos θ= (the height of the laser beam that is taken when the laser beam receiving unit is oriented vertically).

It should be noted that there may be provided a potentiometer 50 for detecting the angle of rotation of the transverse axis 41 of the housing 38 which contains the laser light beam receiving unit 10. An output signal of this potentiometer 50 may be entered as the angle of inclination of the laser beam receiving unit 10 into the controller 20.

The present invention saves time and labor which are normally necessary for actually measuring and entering the angle of inclination of the laser light beam receiving unit 10. Further, the angle of inclination of the laser beam receiving unit 10 can be more accurately determined and can be input into the controller 20 without suffering any error whatsoever.

Figure 8:
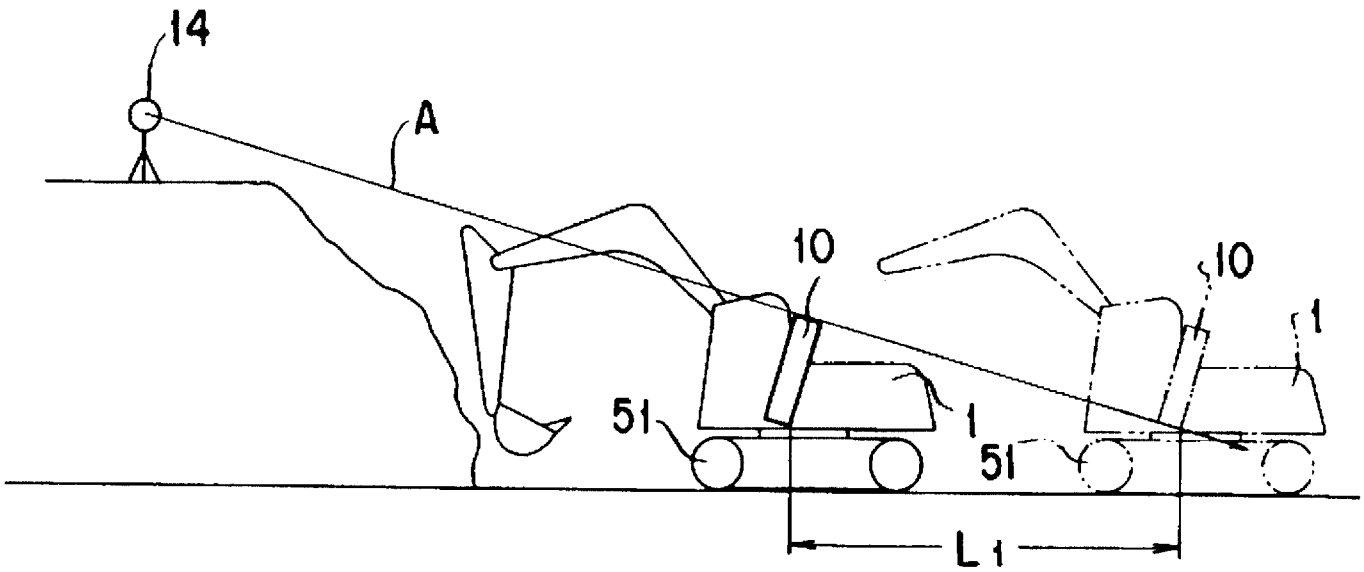
FIG. 8 is a diagrammatic view illustrating a range of travel in which a laser beam can be received in the event that the laser beam receiving unit is inclined.

Since the laser light beam receiving unit 10 can be inclined to the same angle as that of the laser beam A with respect to a horizontal line, even if the angle between the laser beam A and the horizontal line is increased, the laser beam receiving unit 10 will be less liable to enter into a zone in which it is unable to receive the laser beam. Accordingly, as shown in FIG. 8, the distance $L_1$ which the vehicle body 1 is capable of traveling can be increased. In other words, the adjustable range of the angle of the laser beam A with respect to a horizontal line can be made greater, accordingly.

An explanation will now be given with respect to a second embodiment of the present invention.

Figure 9:
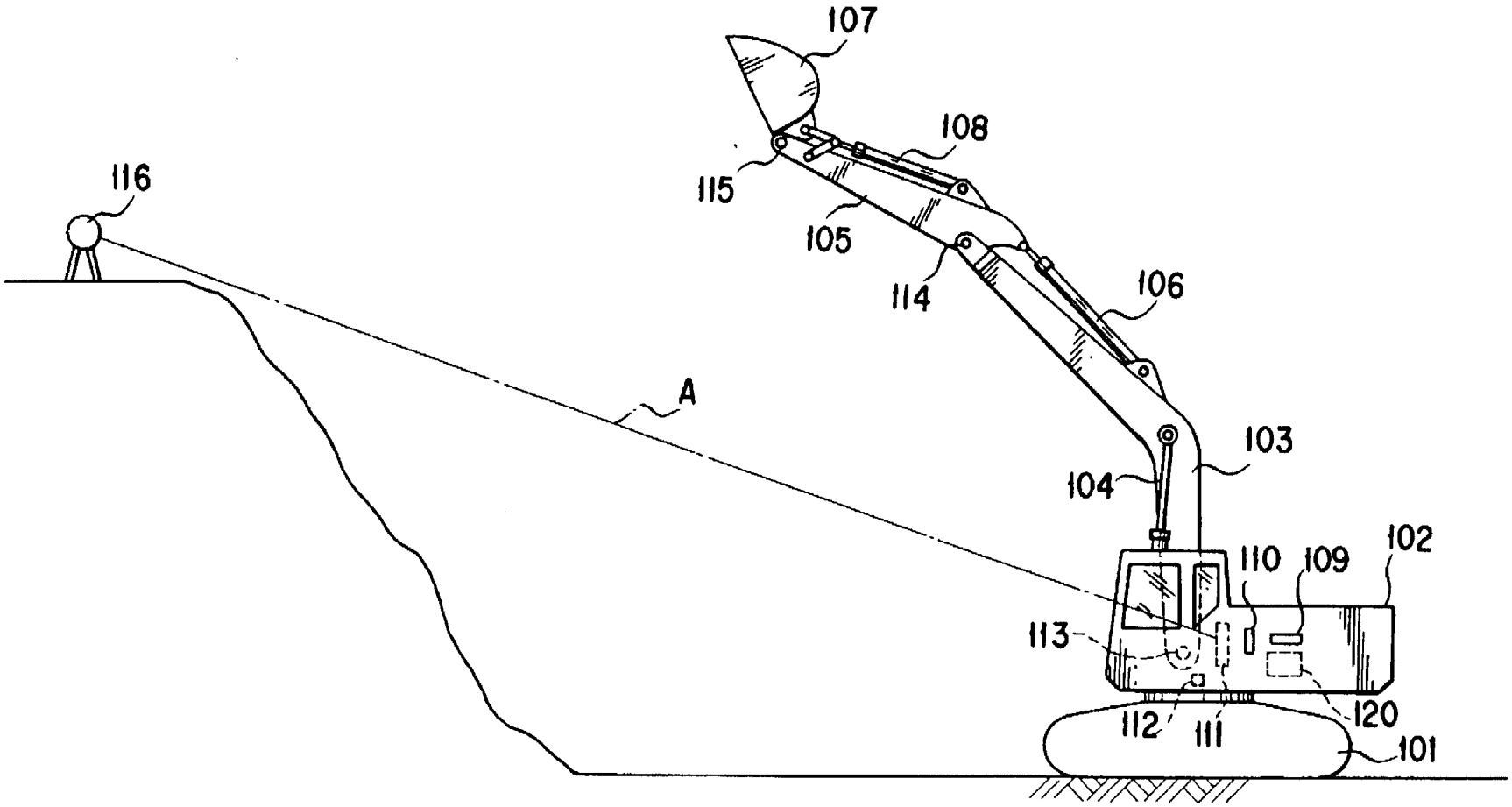
FIG. 9 is a front view illustrating the entire system of a second embodiment of the present invention.

As shown in FIG. 9, a hydraulic shovel is constructed by mounting a vehicle body 102 on a traveling body 101 so that the former may be turnable. A boom 103 is mounted on the vehicle body 102 so that the boom may be turnable upwards and downwards by a boom cylinder 104. An arm 105 is mounted on the boom 103 so that the arm may be turnable upwards and downwards by an arm cylinder 106. A bucket 107 is mounted on the arm so that the bucket may be turnable upwards and downwards by a bucket cylinder 108. The vehicle body 102 has mounted thereon a forward and backward inclinometer 109, a leftward and rightward inclinometer 110, and a laser beam receiving unit 111 for accepting a laser beam. The vehicle body also has a turning angle sensor 112 for detecting a turning angle of the vehicle body 102. There are also provided a boom angle sensor 113 at the fulcrum of the boom 103, an arm angle sensor 114 at the fulcrum of the arm 105, and a bucket angle sensor 115 at the fulcrum of the bucket 107. A laser oscillator 116 is installed on an area or site of excavation for emitting a laser beam A for reception by the laser beam receiving unit 111.

Figure 10:
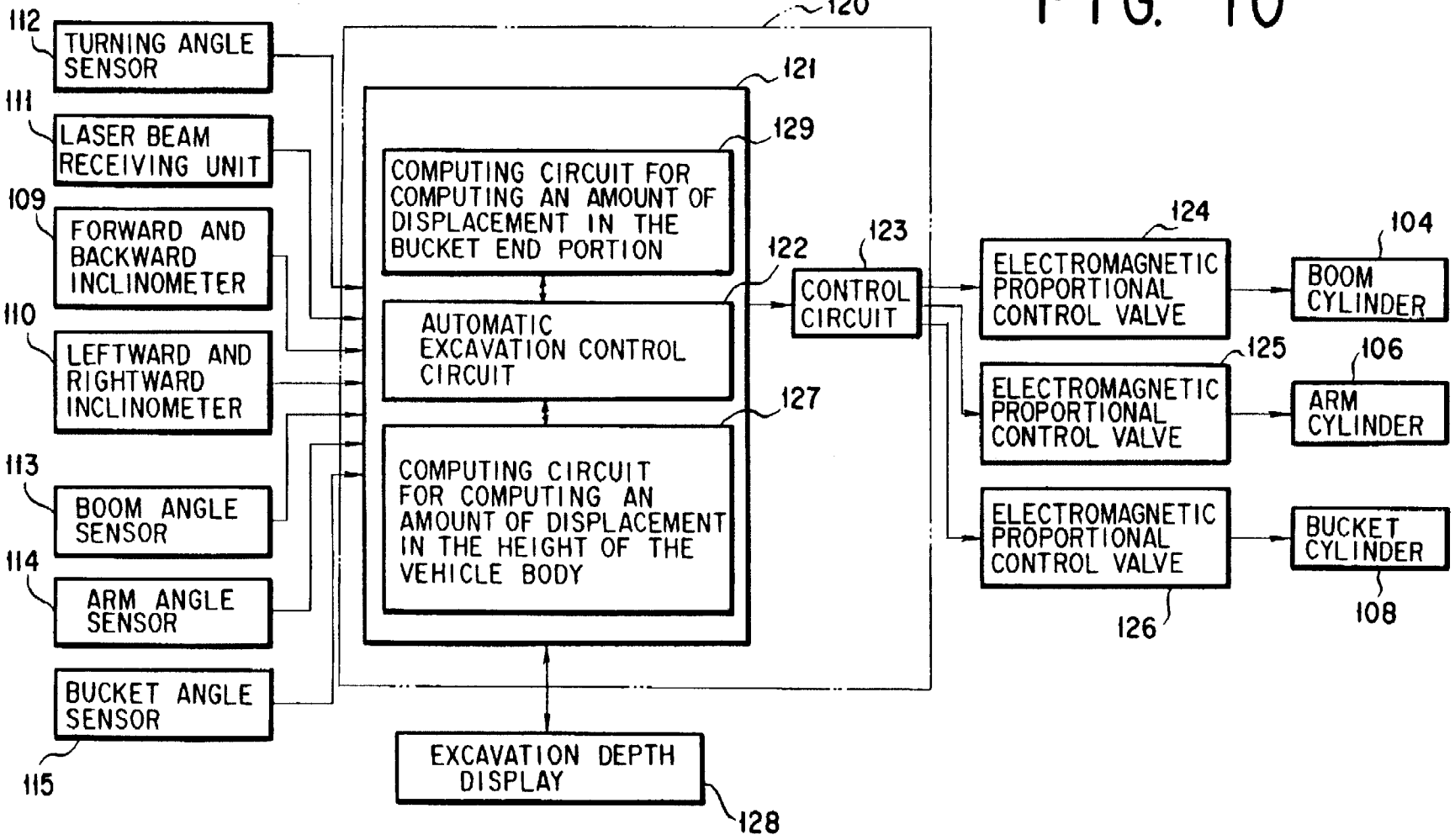
FIG. 10 is a circuit diagram illustrating a control circuit that is used in the above mentioned second embodiment of the present invention.

An explanation will now be given with respect to a certain example of the control circuit in the second embodiment with reference to FIG. 10.

The respective signals of the forward and backward inclinometer 109, the leftward and rightward inclinometer 110, the boom angle sensor 113, the arm angle sensor 114 and the bucket angle sensor 115 are input into an automatic excavation control circuit 122 in an arithmetic circuit 121 of a controller 120. The signals are processed as in the prior art, to compute the height of the end portion of the bucket 7 with reference to a predetermined position of the vehicle body 2. The automatic excavation control circuit 122 furnishes the control circuit 123 with control commands which are based upon the processing results. Control currents are sent from the control circuit 123 to respective electromagnetic valves 124, 125 and 126 for controlling the operations of the boom 103, the arm 105 and the bucket 107. Thus, the boom cylinder 104, the arm cylinder 106 and the bucket cylinder 108 will be extended or contracted to control and linearly displace the height of the excavating bucket end portion 107*a*.

The laser beam receiving unit 111 detects a displacement of the laser light beam receiving unit 111 relative to the laser beam A. The laser receiving unit displacement corresponds to a displacement in the height of the vehicle body 102. A signal that represents such a displacement is input into a vehicle body height displacement amount computing circuit 127 in the above mentioned arithmetic circuit 121. The vehicle body height displacement amount computing circuit 127 receives a signal representative of a degree of the forward or backward inclination of the vehicle body 102 from the forward and backward inclinometer 109 as well as a signal representative of a degree of the leftward or rightward inclination thereof from the leftward and rightward inclinometer 110. From these signals, the circuit 127 computes an amount of variation vehicle body in the height of the vehicle body 102 and provides a corrective signal that is representative thereof. The corrective signal is fed back to the automatic excavation control circuit 122 to modify the control commands or to provide corrected control commands. The corrective signal is used to correct the height of the excavating end portion of the bucket 107 while indicating a depth of the excavation on a display 128 on the basis of the corrected control commands.

Figure 11:
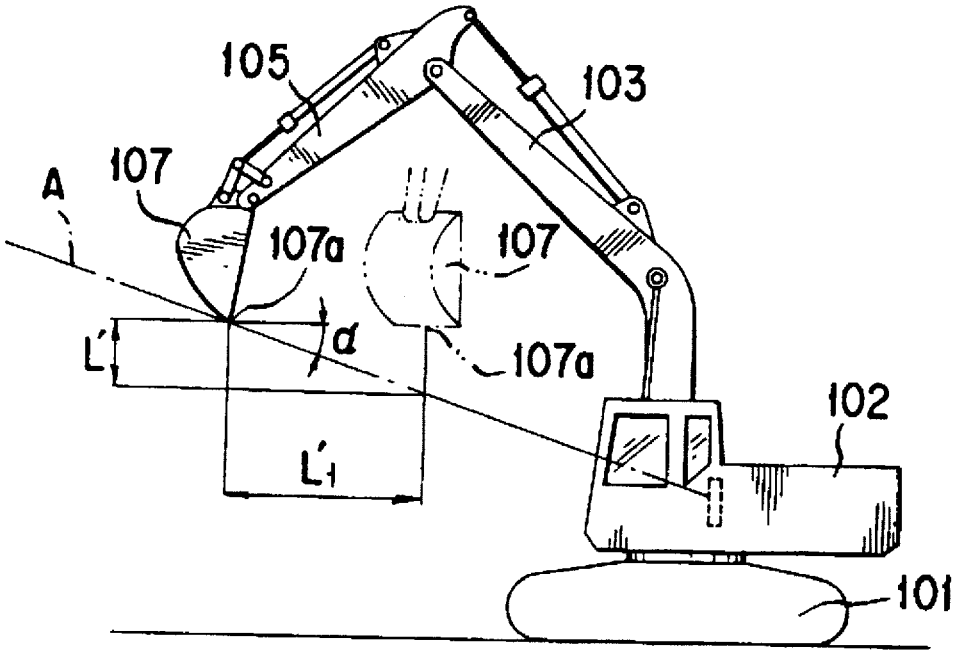
FIG. 11 is a diagrammatic view illustrating a state in which a bucket is being turned in the above mentioned second embodiment of the present invention.
Figure 12:
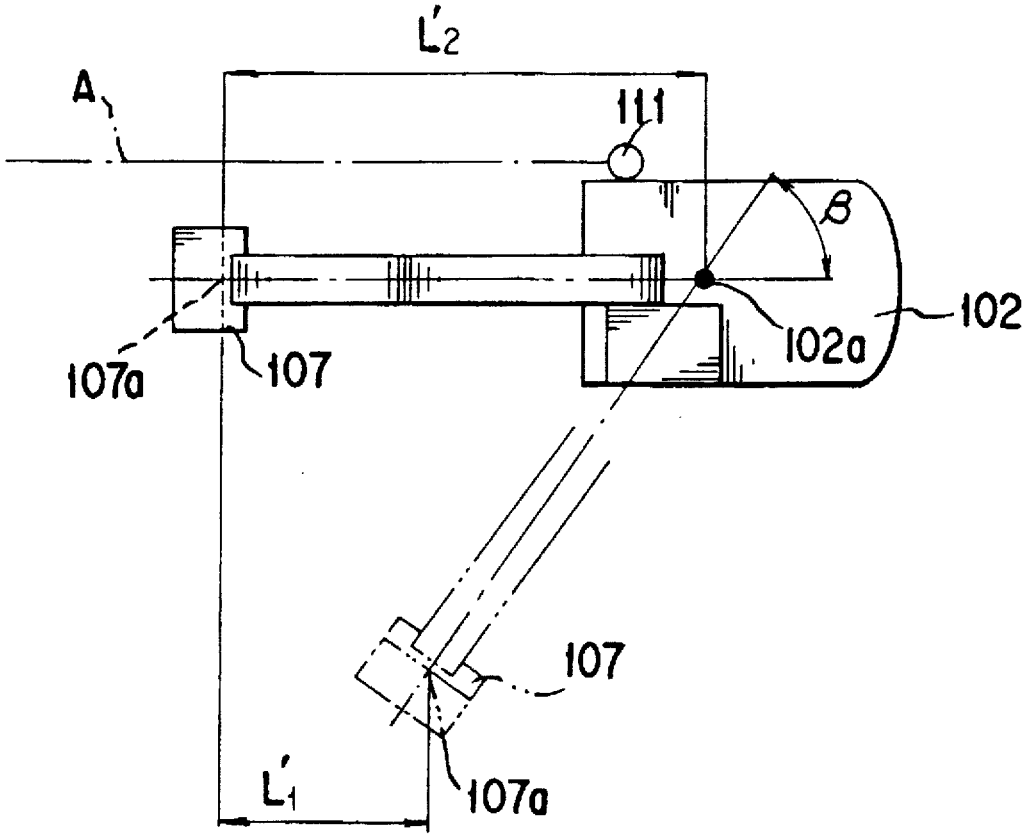
FIG. 12 is a top plan view illustrating the construction that is shown in FIG. 11.

By controlling an excavating operation in a manner as mentioned above, the depth of excavation is kept constant at all times with reference to the laser beam A. Therefore, any excavation operation can be carried out linearly in parallel to the laser beam A. As shown in FIGS. 11 and 12, however, if the traveling body 101 is stopped where the vehicle body 102 is oriented in parallel to the laser beam A and if the vehicle body 102 is then turned as shown in the phantom lines, the bucket 107 will also be turned accordingly so that the distance between the excavating bucket end portion 107*a* and the laser light beam A may be varied by a length L'. Since the laser beam receiving position on the laser beam receiving unit 111 is not alterable, the command for the height of the bucket end portion 107*a* will remain invariable. As a result, the depth of excavation relative to the laser beam A will be deviated by the above mentioned length L', and will thus represent a positioning error. The height of the excavating bucket end portion 107*a* can be corrected, as shown in FIG. 10, by providing a computing circuit 129 for computing an amount of displacement in the height of the excavating bucket end portion 107*a*. The displacement is computed on the basis of a computed angle that is derived from the turning angle sensor 112. This displacement is fed back to the automatic excavation control circuit 122 in order to correct the control commands, and to thus allow for the correction of the height of the excavating bucket end portion 107*a*.

The amount of displacement in the height of the excavating bucket end portion 107*a*, i.e., the error $L'_1$ will satisfy the relationship: $L'=\tan\alpha\times L'_1$ where $\alpha$ is the angle of the laser beam A relative to the horizontal line and $L'_1$ is the distance by which the bucket 107 is displaced relative to the forward and backward directions of the vehicle body 102 when a turn thereof is effected. The angle$\alpha$ of the laser beam A that is relative to the horizontal line has been preset and preliminarily input. Then, the bucket displacement distance $L'_1$ will satisfy the relationship: $L'_1=L'_2-(\cos\beta\times L'_2)$ where $L'_2$ is a length that extends from a turning center 102*a* to the excavating bucket end portion 107*a*. $L'_2$ is obtained by computing horizontal displacement values of the boom 103, the arm 105 and the bucket 107 using the lengths and the angles of the boom 103, the arm 105 and the bucket 107 and adding to these computed values the distance between the attachment point of the boom to the turning center 102*a*. The turning angle $\beta$ of the vehicle body 102 is determined as a difference between a value of the turning angle sensor 111 detected before the vehicle body 102 is turned and a value of the turning angle sensor 111 detected after the vehicle body 102 has been turned.

Thus, the height of the excavating bucket end portion 107*a*, when a turn has been executed, can be computed by adding the amount of displacement in the height of the excavating bucket end portion 107*a* computed in a fashion as set out above to the value in the height of the excavating bucket end portion 107*a* before a turn of the vehicle body is executed. In this way, the depth of excavation can be kept constant even if the vehicle body 102 is turned.

The present invention makes a correction in the height of the end portion of the bucket based on the turning angle of the vehicle body 102. Additionally, the present invention makes a correction based on the angle between the laser beam and a horizontal line. By using these two corrections, the present invention is able to maintain a constant depth of excavation even if the vehicle body is turned and the laser is inclined.

An explanation will now be given with respect to a third embodiment of the present invention.

Figure 13:
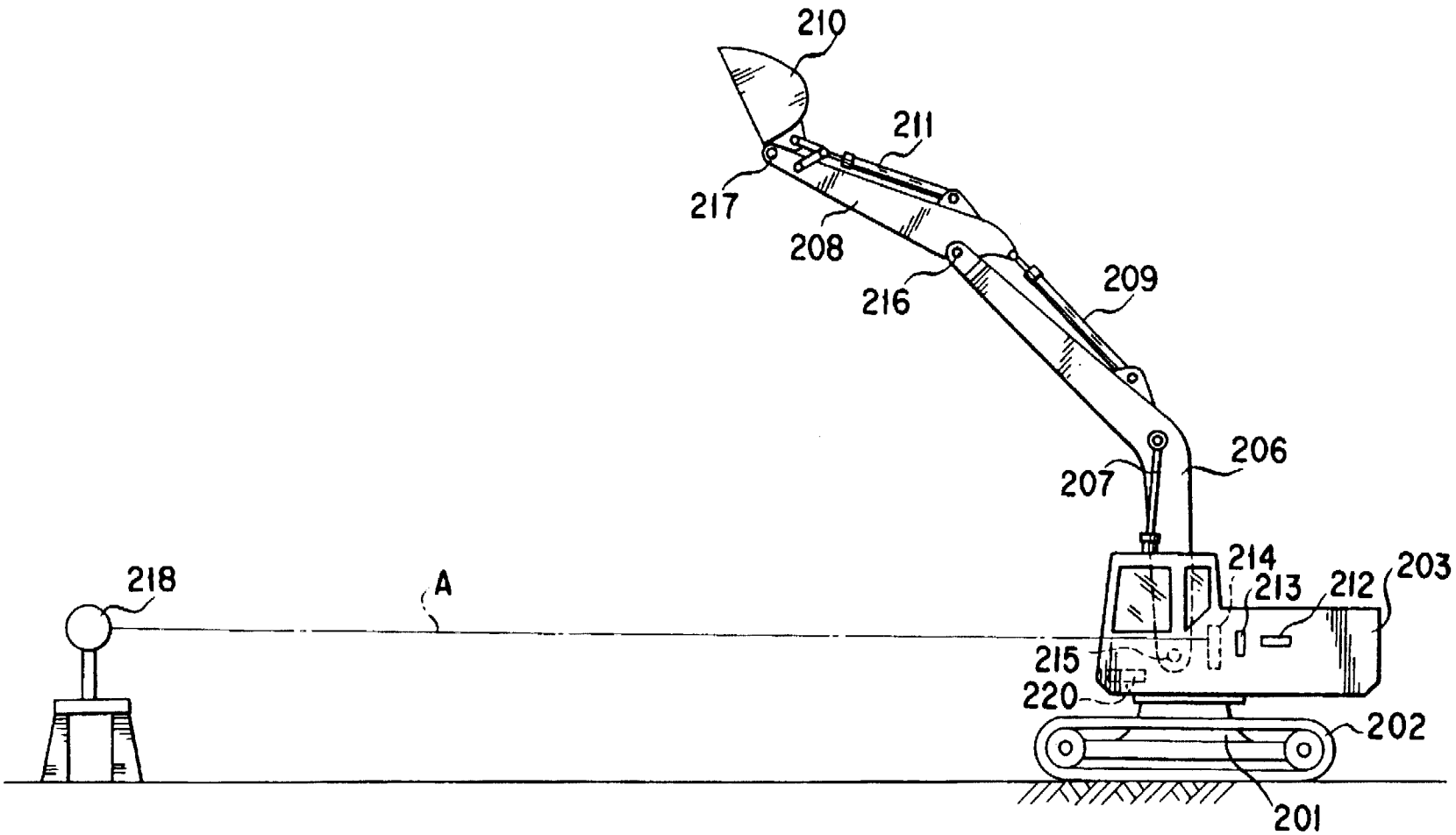
FIG. 13 is a front view illustrating the entire system of a third embodiment of the present invention.
Figure 14:
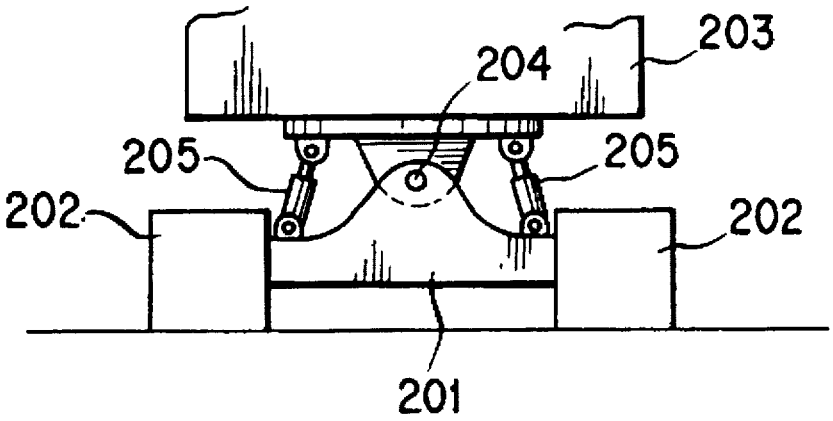
FIG. 14 a diagrammatic view illustrating a coupling structure between a vehicle body and a traveling body in the above mentioned third embodiment of the present invention.

As shown in FIGS. 13 and 14, left and right side crawlers 202 are attached to a traveling body 201 on its left and right hand side. A vehicle body 203 is so coupled to this traveling body 201 by means of a pinch joint 204 so that the vehicle body can be tilted to the left and to the right. A pair of left side and right side inclination cylinders 205 are coupled between the vehicle body 203 and the traveling body 201.

A boom 206 is mounted on the vehicle body 203 so that the vehicle body may be turnable upwards and downwards with a boom cylinder 207. An arm 208 is mounted on the boom 206 so that the arm may be turnable upwards and downwards with an arm cylinder 209. A bucket 210 is mounted on the arm 208 so that the bucket may be turnable upwards and downwards with a bucket cylinder 211. The vehicle body 203 has mounted thereon a forward and backward inclinometer 212, a leftward and rightward inclinometer 213, and a laser light beam receiving unit 214 for accepting a laser beam A. There are also provided a boom angle sensor 215 at a fulcrum of the boom 206, an arm angle sensor 216 at a fulcrum of the arm 208, and a bucket angle sensor 217 at a fulcrum of the bucket 210. A laser oscillator 218 is installed on an area or site of excavation for emitting the laser beam A for reception by the above mentioned laser beam receiving unit 214.

An explanation will now be given with respect to a certain example of the control circuit in the third embodiment with reference to FIG. 15.

The respective signals of the forward and backward inclinometer 212, the leftward and rightward inclinometer 213, the boom angle sensor 215, the arm angle sensor 216 and the bucket angle sensor 217 are input into an automatic excavation control circuit 222 in an arithmetic circuit 221 of a controller 220. These signals are processed as in the prior art, to compute the height of the excavating end portion of the bucket 210 with reference to a predetermined position of the vehicle body 203 on the basis of the boom angle, the arm angle and the bucket angle. The automatic excavation control circuit 222 provides the control circuit 223 with control commands which are based upon the processing results. Control currents are sent from the control circuit 223 to the respective electromagnetic valves for controlling the operations of the boom 206, the arm 208 and the bucket 210. The boom cylinder 207, the arm cylinder 209 and the bucket cylinder 211 are extended or contracted to control the height of the excavating end portion of the bucket 210 so that the bucket 210 may be displaced so as to proceed with the excavation.

The laser beam receiving unit 214 detects a displacement of the laser beam receiving unit 214 relative to the laser beam A. The displacement of the laser beam receiving unit corresponds to the displacement in the height of the vehicle body 203. A signal representative of such a displacement is input into a computing circuit 224 for computing an amount of displacement in the height of vehicle body 203. The computing circuit 224 receives a signal representative of a degree of the forward or backward inclination of the upper vehicle body 103 from the forward and backward inclinometer 212. From this signal, the circuit 224 computes an amount of displacement in the height of the upper vehicle body 203 and provides a corrective signal that is representative thereof. The corrective signal is fed back to the automatic excavation control circuit 222 to modify the above mentioned control commands or to provide corrected control commands. Based on these commands the height of the excavating end portion of the bucket 210 is corrected and the depth of the excavation is indicated on a display 225. The height of the excavating end portion of the bucket 210 is preset as being located at the center of the width of the vehicle.

Figure 15:
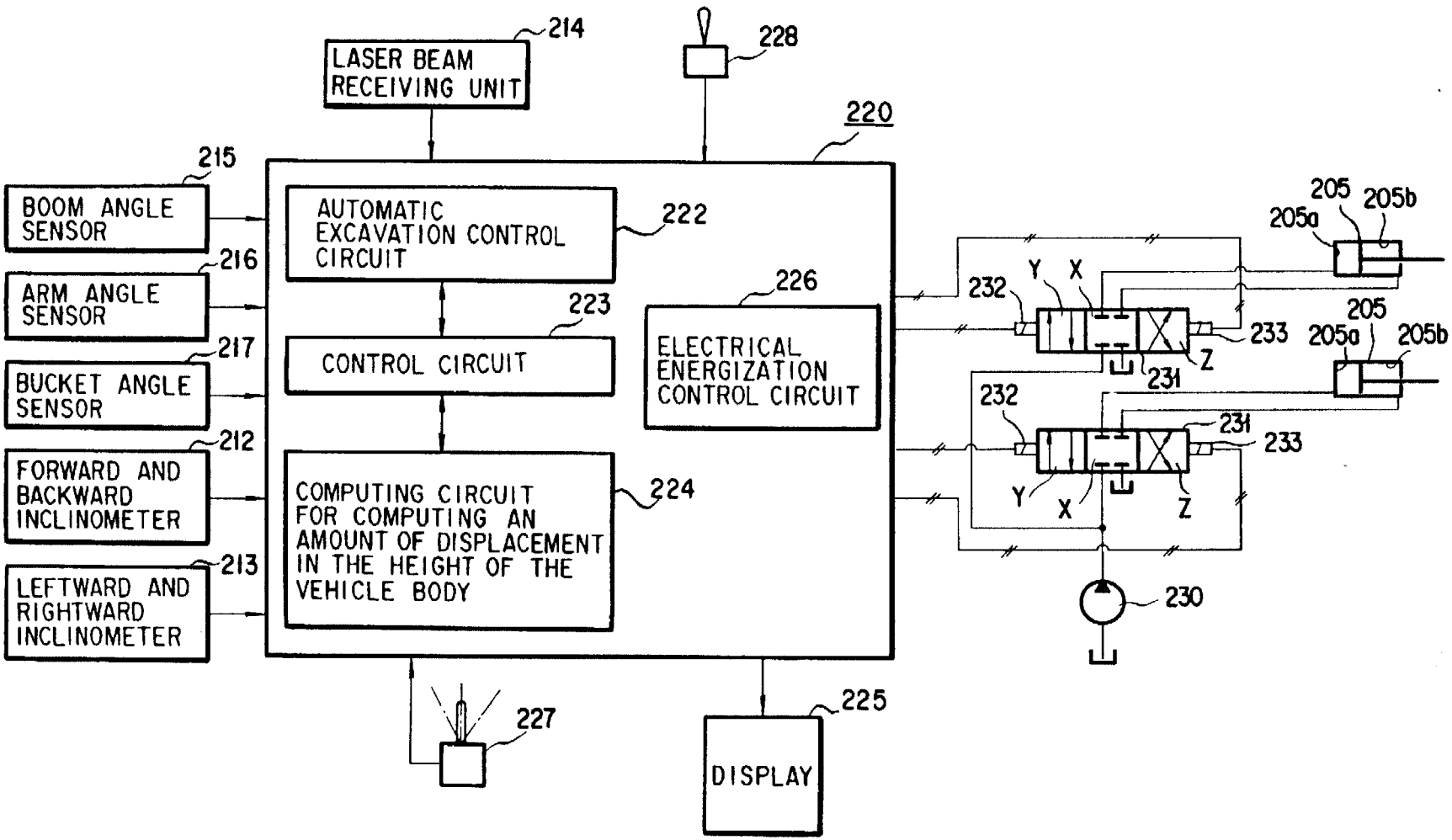
FIG. 15 is a circuit diagram illustrating a control circuit that is used in the above mentioned third embodiment of the present invention.

As illustrated in FIG. 15, the expanding chamber 205*a* and the contracting chamber 205*b* of each of the above mentioned inclination cylinders 205 will be supplied with a discharge pressure fluid from a hydraulic pump 230 under control of switching valves 231. The switching valves 231 will normally be in neutral position X. If the first solenoid 232 or the second solenoid 233 is electrically energized, the switching valves 231 will assume a first position Y for feeding the expanding chamber 205*a* with the pressure fluid or a second position Z for feeding the contracting chamber 205*b* with the pressure fluid, respectively.

The respective first and second solenoids 232 and 233 of the switching valves 231 are adapted to be energized by an electrical energization control circuit 226 in the controller 220. This electrical energization control circuit 226 is adapted to be activated by a manual inclination lever 227 to provide a rightward inclination signal and a leftward inclination signal depending upon the manually inclined positions of the lever 227. Thus, when the first and second solenoids 232 and 233 are provided with rightward and leftward inclination signals respectively, one of the switching valves 231 will take the first position Y, expanding one cylinder, and the other switching valve 231 will take the second position Z, contracting the other cylinder. This causes the vehicle body 203 to be tilted to the right or to the left.

If the controller 220 is furnished with an automatic horizontal control input signal from an automatic horizontal control switch 228, the respective first and second solenoids 232 and 233 are electrically energized by the electrical energization control circuit 226. The automatic horizontal control input signal is representative of a degree of the leftward or rightward angle of inclination supplied by the leftward and rightward inclinometer 13. The action of the solenoids serves to orient the vehicle body 203 horizontally to orient the surface of excavation horizontally. At this point in time, an angle of inclination (i.e. an absolute angle of inclination) of the vehicle body 203 with respect to a horizontal line before a correction is made will be indicated on the display 225.

Figure 16:
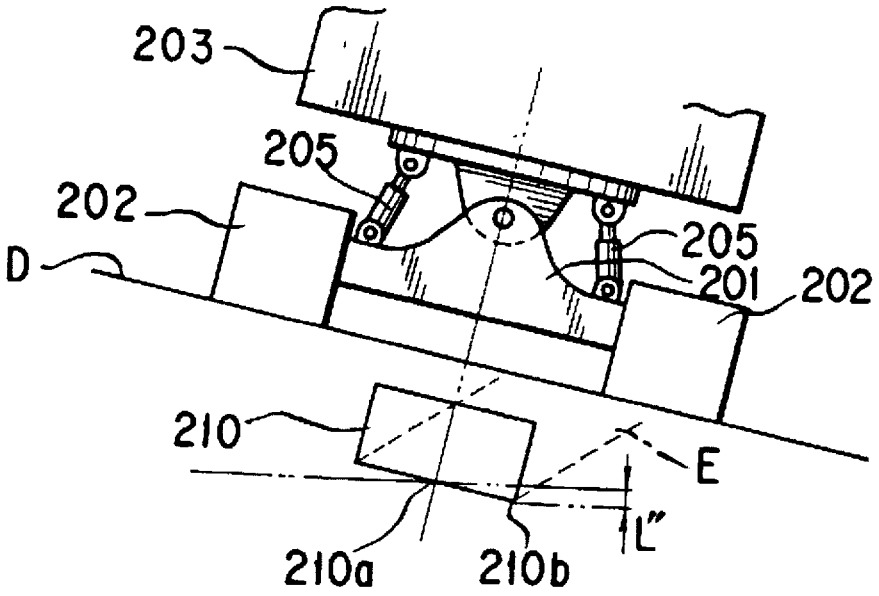
FIG. 16 is a diagrammatic view illustrating a state in which the traveling body is inclined in the above mentioned third embodiment of the present invention.

For example, as shown in FIG. 16, consider an excavation site D that slopes down and to the right. In this case, the vehicle body, as well as the bucket will be titled downward and to the right. If a central portion 210*a* of the width of the excavating bucket 210 is modified to assume a preselected height, one end portion 210*b* of the excavating bucket 210 will be lowered by a distance L" as shown. If the excavation is continued the surface E of the excavation will be made oblique with respect to a horizontal line.

In accordance with the present embodiment, however, if the vehicle body 203 is inclined downward and to the right, a rightward down inclination signal will be furnished from the leftward and rightward inclinometer 213 to the controller 220. Since the first and second solenoids 232 and 233 are then electrically energized by the electrical energization control circuit 226 so as to incline the vehicle body 203 leftwards, the vehicle body 203 will be inclined leftwards by means of the left side and right side inclination cylinders 205. Once the vehicle body 203 is thus oriented horizontally, there will no longer be the rightward down inclination signal. As a result, the first and second solenoids 232 and 233 will no longer be energized, and the switching valves 231 will then be returned to their neutral position X.

The present invention corrects the attitude of the vehicle body and thereby allows the orientation of the bucket to be kept constant with respect to the surface of the excavation. The vehicle body 203 can also be oriented at any desired angle of inclination by operating the manual inclination lever 227.

While the present invention has been described with respect to certain embodiments, it should be appreciated that many alterations thereof, omissions therefrom and additions thereto can be made without departing from the essence and the scope of the present invention. Accordingly, it should be understood that the present invention is not limited to the specific embodiments thereof set out above, but includes all possible embodiments thereof that can be made with respect to the features specifically set forth in the appended claims and all equivalents thereof.

What is claimed is:

1. A linear excavation control apparatus for use with a hydraulic power shovel having a boom, a boom actuator, an arm, an arm actuator, an excavating member, and an excavating member actuator mounted on a vehicle body which is mounted on, and able to be turned relative to, a traveling body, comprising:

a laser oscillator, to be installed on a surface of a target site of excavation;

a laser beam receiving unit, mountable upon the vehicle body of the hydraulic power shovel, for receiving a laser beam transmitted from said laser oscillator, and detecting a laser beam receiving position at which the laser beam impinges said laser beam receiving unit;

a boom angle sensor for detecting an angle of the boom and for generating a boom angle detection signal;

an arm angle sensor for detecting an angle of the arm and for generating an arm angle detection signal;

an excavating member angle sensor for detecting an angle of the excavating member and for generating an excavating member angle detection signal;

a turning angle sensor for detecting a turning angle of the vehicle body with respect to the traveling body and for generating a turning angle signal;

a controller for controlling a path of excavation of the excavating member based on the laser beam receiving position, by, computing a height of an end portion of the excavating member with respect to a reference position of the vehicle body based on said boom angle detection signal, said arm angle detection signal, and said excavating member angle detection signal and generating an excavating member height signal, detecting an amount of displacement in height of the vehicle body in response to a variation in the laser beam receiving position and generating a vehicle height displacement signal representative thereof, computing, based on said turning angle signal and a signal representative of an angle between the laser beam and a horizontal line, an amount of displacement in height of the end portion of the excavating member with respect to the laser beam that occurs when the vehicle body is turned and generating an excavating member displacement signal representative thereof;

providing control signals to the boom actuator, the arm actuator, and the excavating member actuator in response to said vehicle height displacement signal, said excavating member height signal, and said excavating member displacement signal for moving the boom, arm, and excavating member so as to keep the height of the end portion of the excavating member constant with respect to the laser beam.

2. A linear excavation control apparatus as claimed in claim 1, wherein:

said controller computes the turning angle of the vehicle body based on a turning angle signal generated by said turning angle sensor before the vehicle body is turned and a turning angle signal generated by said turning angle sensor after the vehicle body is turned.

3. A linear excavation control apparatus as claimed in claim 1, wherein:

said laser beam receiving unit is angularly adjustable with respect to a vertical line.

4. A liner excavation control apparatus as claimed in claim 3, further comprising:

laser beam receiving unit angle detection means for detecting an angle of inclination of said laser beam receiving unit and generating a laser beam receiving unit angle signal; wherein:

said controller is able to alter the laser beam receiving position detected by said laser beam receiving unit on the basis of said laser beam receiving unit signal.

5. A linear excavation control apparatus for use with a hydraulic power shovel having an excavating member, a traveling body movable in a direction of travel, and a vehicle body mounted on the traveling body and able to be inclined in a direction orthogonal to the direction of travel of the traveling body, said linear excavation control apparatus comprising:

a laser oscillator, to be installed on a surface of a target site of excavation;

a laser beam receiving unit, mountable upon the vehicle body of the hydraulic power shovel, for receiving a laser beam transmitted from said laser oscillator, and detecting a laser beam receiving position at which the laser beam impinges said laser beam receiving unit;

inclination means for inclining the vehicle body in a direction orthogonal to the direction of travel of the traveling body;

an orthogonal inclinometer for detecting an angle of inclination of the vehicle body and generating an orthogonal inclination signal;

a controller for, controlling a path of excavation of the excavating member based on the laser beam receiving position, and operating said inclination means to horizontally orient the vehicle body in response to said orthogonal inclination signal.

6. A linear excavation control apparatus as claimed in claim 5, wherein:

said inclination means comprises, an inclination cylinder coupled between the vehicle body and the traveling body, and a switching valve connected to said inclination cylinder to supply said inclination cylinder with pressure fluid for inclining the vehicle body; and said controller able to control said switching valve based on said orthogonal inclination signal.

7. A linear excavation control apparatus as claimed in claim 5, wherein:

said laser beam receiving unit is angularly adjustable with respect to a vertical line.

8. A linear excavation control apparatus as claimed in claim 7, further comprising:

laser beam receiving unit angle detection means for detecting an angle of inclination of said laser beam receiving unit and generating a laser beam receiving unit angle signal; wherein:

said controller is able to alter the laser beam receiving position detected by said laser beam receiving unit on the basis of said laser beam receiving unit signal.

9. A linear excavation apparatus comprising:

a hydraulic power shovel which comprises:

a traveling body;

a vehicle body mounted on and able to be turned relative to said traveling body and having mounted thereon, a boom, a boom actuator, an arm, an arm actuator, an excavating member, and an excavating member actuator; and an excavation control apparatus comprising:

a laser oscillator, to be installed on a surface of a target site of excavation;

a laser beam receiving unit, mounted on said vehicle body, for receiving a laser beam transmitted from said laser oscillator, and detecting a laser beam receiving position at which the laser beam impinges said laser beam receiving unit;

a boom angle sensor for detecting an angle of said boom and for generating a boom angle detection signal;

an arm angle sensor for detecting an angle of said arm and for generating an arm angle detection signal;

an excavating member angle sensor for detecting an angle of said excavating member and for generating an excavating member angle detection signal;

a turning angle sensor for detecting a turning angle of said vehicle body with respect to said traveling body and for generating a turning angle signal;

a controller for controlling a path of excavation of said excavating member based on the laser beam receiving position, by, computing a height of an end portion of said excavating member with respect to a reference position of said vehicle body based on said boom angle detection signal, said arm angle detection signal, and said excavating member angle detection signal and generating an excavating member height signal, detecting an amount of displacement in height of said vehicle body in response to a variation in the laser beam receiving position and generating a vehicle height displacement signal representative thereof, computing, based on said turning angle signal and a signal representative of an angle between the laser beam and a horizontal line, an amount of displacement in height of the end portion of said excavating member with respect to the laser beam that occurs when said vehicle body is turned and generating an excavating member displacement signal representative thereof; and providing control signals to said boom actuator, said arm actuator, and said excavating member actuator in response to said vehicle height displacement signal, said excavating member height signal, and said excavating member displacement signal for moving said boom, said arm, and said excavating member so as to keep the height of the end portion of said excavating member constant with respect to the laser beam.

10. A linear excavation apparatus as claimed in claim 9, wherein:

said controller computes the turning angle of said vehicle body based on a turning angle signal generated by said turning angle sensor before said vehicle body is turned and a turning angle signal generated by said turning angle sensor after said vehicle body is turned.

11. A linear excavation apparatus as claimed in claim 9, wherein:

said laser beam receiving unit is angularly adjustable with respect to a vertical line.

12. A linear excavation apparatus as claimed in claim 11, further comprising:

laser beam receiving unit angle detection means for detecting an angle of inclination of said laser beam receiving unit and generating a laser beam receiving unit angle signal; wherein:

said controller is able to alter the laser beam receiving position detected by said laser beam receiving unit on the basis of said laser beam receiving unit signal.

13. A linear excavation apparatus as claimed in claim 9, wherein said excavating member comprises a bucket.

14. A linear excavation apparatus comprising:

a hydraulic power shovel which comprises:

a traveling body movable in a direction of travel;

a vehicle body mounted on said traveling body and able to be inclined in a direction orthogonal to the direction of travel of said traveling body; and an excavating member; and an excavation control apparatus comprising:

a laser oscillator, to be installed on a surface of a target site of excavation;

a laser beam receiving unit, mounted on said vehicle body, for receiving a laser beam transmitted from said laser oscillator, and detecting a laser beam receiving position at which the laser beam impinges said laser beam receiving unit;

inclination means for inclining said vehicle body in a direction orthogonal to the direction of travel of said traveling body;

an orthogonal inclinometer for detecting an angle of inclination of said vehicle body and generating an orthogonal inclination signal; and a controller for, controlling an attitude of excavation of said excavating member based on the laser beam receiving position, and operating said inclination means to horizontally orient said vehicle body in response to said orthogonal inclination signal.

15. A linear excavation apparatus as claimed in claim 14, wherein:

said inclination means comprises:

an inclination cylinder coupled between said vehicle body and said traveling body;

a switching valve connected to said inclination cylinder to supply said inclination cylinder with pressure fluid for inclining said vehicle body; and said controller able to control said switching valve based on said orthogonal inclination signal.

16. A linear excavation apparatus as claimed in claim 14, wherein:

said laser beam receiving unit is angularly adjustable with respect to a vertical line.

17. A linear excavation control apparatus as claimed in claim 16, further comprising:

laser beam receiving unit angle detection means for detecting an angle of inclination of said laser beam receiving unit and generating a laser beam receiving unit angle signal; wherein:

said controller is able to alter the laser beam receiving position detected by said laser beam receiving unit on the basis of said laser beam receiving unit signal.

18. A linear excavation apparatus as claimed in claim 14, wherein said excavating member comprises a bucket.

* * * * *